US010491989B2

(12) United States Patent
Cheng

(10) Patent No.: US 10,491,989 B2
(45) Date of Patent: Nov. 26, 2019

(54) ELECTRONIC DEVICE

(71) Applicant: Chiun Mai Communication Systems, Inc., New Taipei (TW)

(72) Inventor: Yuan-Min Cheng, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 107 days.

(21) Appl. No.: 15/636,526

(22) Filed: Jun. 28, 2017

(65) Prior Publication Data

US 2017/0374451 A1 Dec. 28, 2017

(30) Foreign Application Priority Data

Jun. 28, 2016 (CN) ..... 2016 1 0484016

(51) Int. Cl.

| | |
|---|---|
| ***H04R 9/06*** | (2006.01) |
| ***H04R 1/28*** | (2006.01) |
| ***H04R 1/02*** | (2006.01) |
| *H04R 1/42* | (2006.01) |

(52) U.S. Cl.

CPC ..... *H04R 1/2842* (2013.01); *H04R 1/025* (2013.01); *H04R 1/42* (2013.01); *H04R 2201/02* (2013.01); *H04R 2499/11* (2013.01)

(58) Field of Classification Search

CPC ..... H04R 1/2842; H04R 1/025; H04R 1/323; H04R 1/42; H04R 2201/02; H04R 2499/11

USPC ..... 381/334, 336, 337, 339, 340, 347, 349; 181/175–179, 191; 455/575.1

See application file for complete search history.

(56) References Cited

U.S. PATENT DOCUMENTS

| | | | | |
|---|---|---|---|---|
| 5,883,966 | A * | 3/1999 | Kubo | H04M 1/0202 379/433.02 |
| 7,961,900 | B2 * | 6/2011 | Zurek | H04M 1/605 379/433.02 |
| 8,098,868 | B2 * | 1/2012 | Kim | H04M 1/035 381/351 |
| 8,170,259 | B2 * | 5/2012 | Liu | H04R 1/02 381/365 |
| 8,596,412 | B1 * | 12/2013 | Jorgensen | G06F 1/1626 181/202 |
| 8,944,209 | B1 * | 2/2015 | Fields | G10K 11/08 181/178 |
| 9,198,305 | B2 * | 11/2015 | Smith | G10K 11/28 |
| 9,258,397 | B2 * | 2/2016 | Lee | H04M 1/04 |
| 10,178,210 | B2 * | 1/2019 | Kirschman | H04M 1/05 |
| 2010/0219012 | A1 * | 9/2010 | Baumbach | G10K 11/025 181/177 |
| 2012/0027237 | A1 * | 2/2012 | Lin | H04R 1/02 381/340 |

(Continued)

FOREIGN PATENT DOCUMENTS

| | | | |
|---|---|---|---|
| CN | 201438752 | U | 4/2010 |
| CN | 201667705 | U | 12/2010 |

(Continued)

*Primary Examiner* — Xu Mei

(74) *Attorney, Agent, or Firm* — ScienBiziP, P.C.

(57) ABSTRACT

An electronic device includes a body and a sound cavity assembly. The sound cavity assembly is coupled to the body and forms a sound cavity cooperatively with the body. The sound cavity includes a speaker and a cover. The cover is coupled to the body and at least partially protruding from the body to adjust a volume of the sound cavity.

9 Claims, 12 Drawing Sheets

(56) References Cited

U.S. PATENT DOCUMENTS

2013/0170686 A1* 7/2013 Lester, Jr. ..... H04R 1/2803
381/338

FOREIGN PATENT DOCUMENTS

| | | | |
|---|---|---|---|
| CN | 201830307 | U | 5/2011 |
| CN | 203933737 | U | 11/2014 |
| CN | 204119426 | U | 1/2015 |
| TW | 200803585 | A | 1/2008 |
| TW | M446470 | U1 | 2/2013 |

* cited by examiner

ELECTRONIC DEVICE

FIELD

The subject matter herein generally relates to an electronic device that reinforces bass effect.

BACKGROUND

Many electronic devices have limited internal space to provide sound cavities, and thus resulting in the electronic devices not having a good bass in the sounds they produce.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout several views.

DETAILED DESCRIPTION

Figure 1:
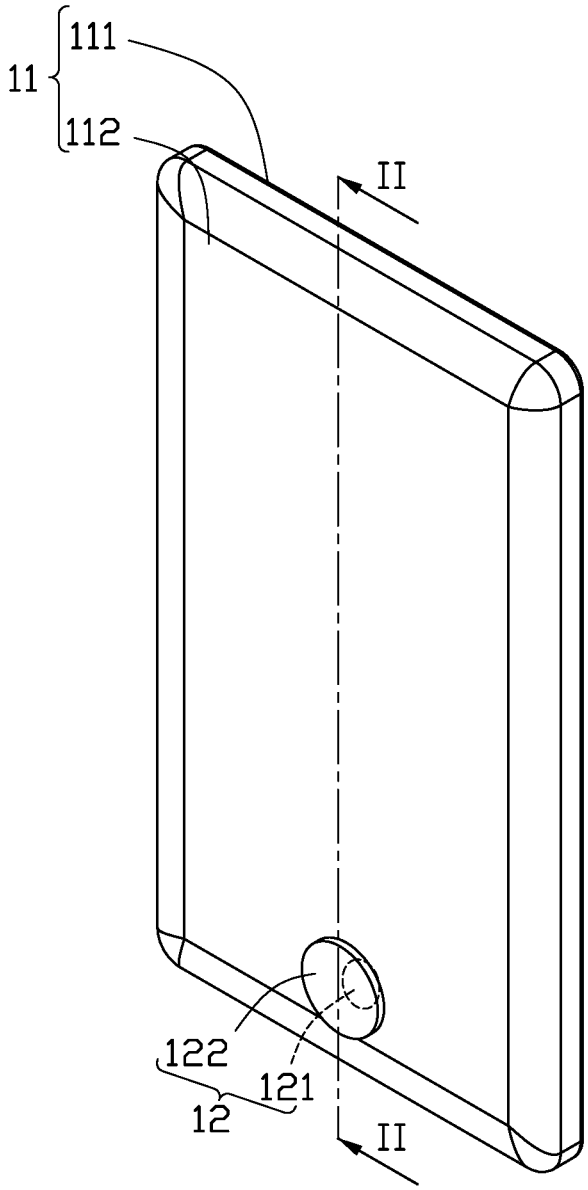
FIG. 1 is an isometric view of a first exemplary embodiment of an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

An electronic device is disclosed, reinforcing a bass effect of the electronic device by enlarging a sound cavity. Additionally, the enlarged sound cavity does not occupy an internal space of the electronic device. The electronic device can be, but is not limited to, a mobile phone, a tablet computer, or a personal digital assistant (PDA).

Figure 2:
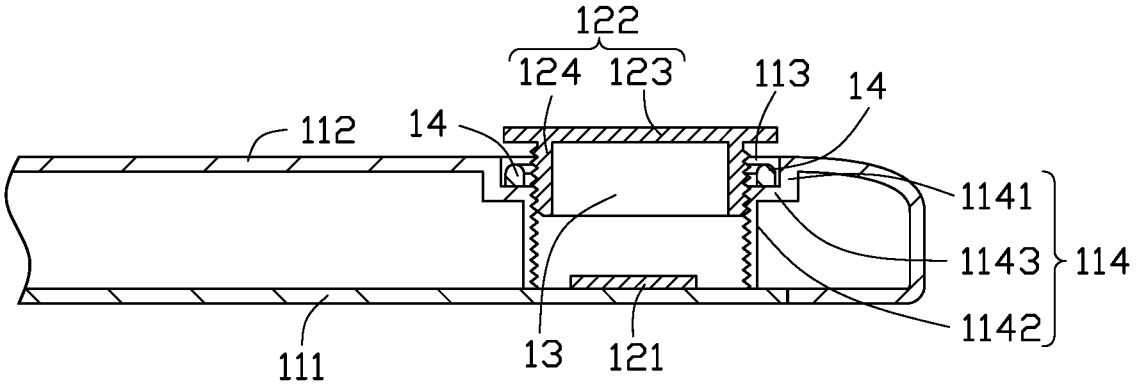
FIG. 2 is a partially cross-sectional view of the electronic device along line II-II of FIG. 1.

FIGS. 1 and 2 illustrate a first exemplary embodiment of an electronic device 100. The electronic device 100 includes a body 11 and a sound cavity assembly 12. The body 11 and the sound cavity assembly 12 are in air communication to form a closed sound cavity 13. A portion of the sound cavity 13 protrudes from the body 11.

The body 11 is substantially rectangular and includes a first body 111 and a parallel second body 112. The body 11 can be made of metal, plastic, carbon fiber, glass, woody, bamboo, or ceramic material. Preferably, the body 11 is made of aluminum alloy or magnesium alloy. The first body 111 defines several sounding holes (not shown) in air communication with the sound cavity 13 for transmitting sound outward from the sound cavity 13 to the exterior of the body 11 through the side of the first body 111. The second body 112 defines a hole 113. The second body 112 includes a connecting portion 114 located at the hole 113. The connecting portion 114 extends from the portion of the second body 112 defining the hole 113 towards the interior of the second body 112. The connecting portion 114 is a hollow cylinder. The connecting portion 114 includes a first portion 1141 and a second portion 1142. The first portion 1141 extends along the hole 113, the second portion 1142 extends from the first portion 1141 towards the first body 111. A diameter of the second portion 1142 is smaller than that of the first portion 1141, and a step portion 1143 is formed connecting the first portion 1141 and the second portion 1142. A seal ring 14 is arranged to an internal wall of the first portion 1141 and on the step portion 1143. An external diameter of the seal ring 14 is substantially same as an inner diameter of the first portion 1141, an inner diameter of the seal ring 14 is substantially same as an inner diameter of the second portion 1142, and a thickness of the seal ring 14 is smaller than a height of the first portion 1141. An internal wall of the second portion 1142 is threaded (the first thread).

The sound cavity assembly 12 includes a speaker 121 and a cover 122. The speaker 121 is received in the body 11. In at least one embodiment, the speaker 121 is coupled to the first body 111. The cover 122 is coupled to the second body 112 and partially protrudes from the second body 112. The cover 122 is aligned to the speaker 121. The cover 122 includes a hat portion 123 and an engaging portion 124. The hat portion 123 is substantially perpendicular to the engaging portion 124. In at least one embodiment, the hat portion 123 is substantially a plane board, and the engaging portion 124 is substantially a hollow cylinder. A diameter of the hat portion 123 is greater than that of the engaging portion 124, the diameter of the hat portion 123 is greater than or same as that of the first portion 1141, and the diameter of the engaging portion 124 is substantially same as that of the second portion 1142. The external wall of the engaging portion 124 includes a second thread corresponding to the first thread of the second portion 1142.

In assembly, the engaging portion 124 inserts through the connecting portion 114 and the seal ring 14, the cover 122 is rotated to engage the second thread of the engaging portion 124 with the first thread of the second portion 1142. Thus, the cover 122, the body 11, and the speaker 121 cooperatively enclose a closed sound cavity 13. The seal ring 14 forms a seal between the engaging portion 124, the step portion 1143, the first portion 1141, the second portion 1142, and the hat portion 123. The cover 122 can be rotated away from the first body 111 to enlarge a volume of the sound cavity 13, and thus reinforcing a bass effect of the sound cavity 13. The cover 122 can be rotated towards the first body 111 until parallel to the second body 112 to decrease a thickness of the body 11. Additionally, the cover 122 can be disassembled from the body 11 and exchanged for a different cover with a different size.

Figure 3:
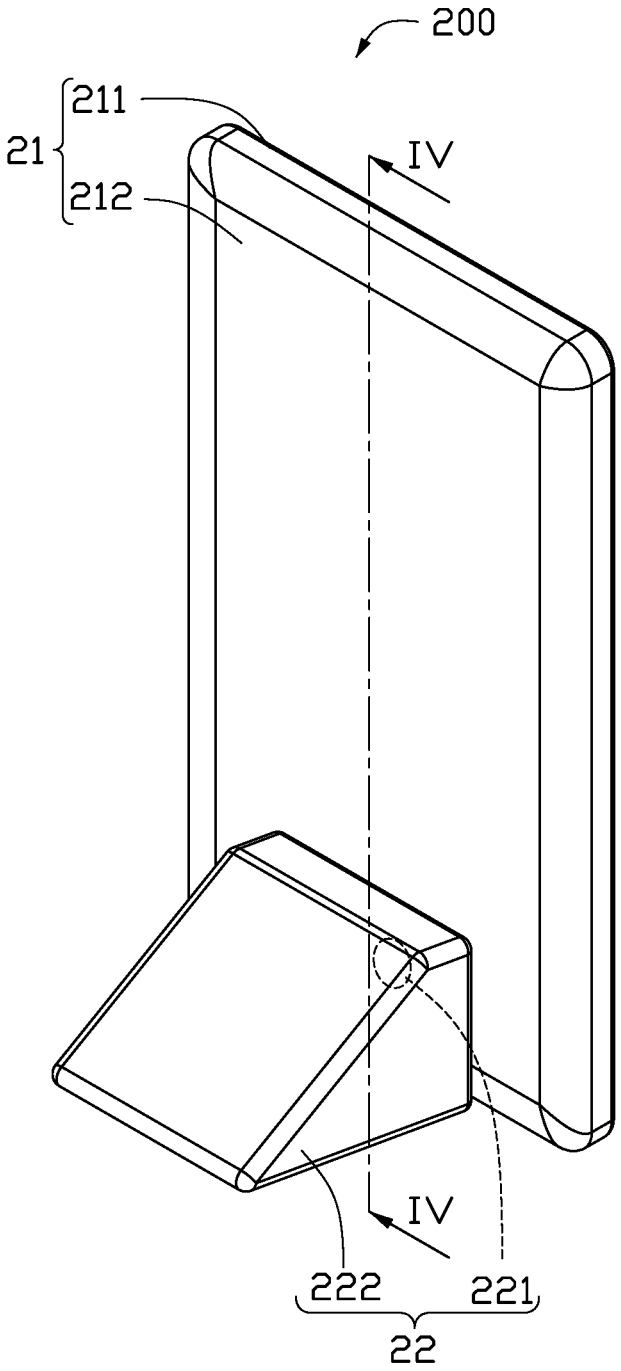
FIG. 3 is an isometric view of a second exemplary embodiment of an electronic device.
Figure 4:
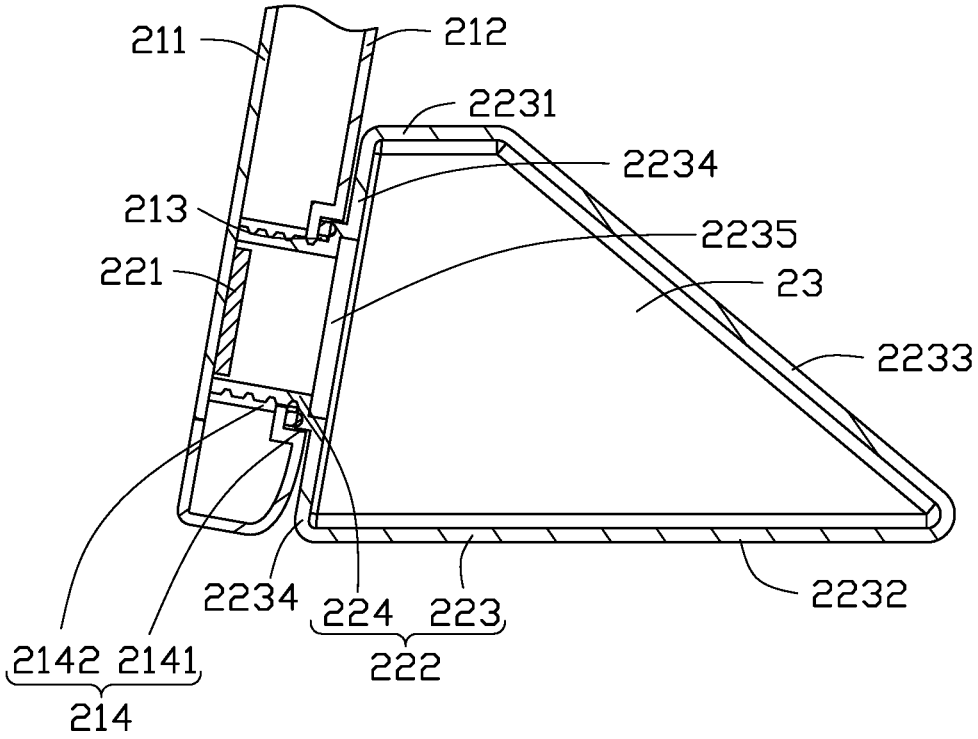
FIG. 4 is a partially cross-sectional view of the electronic device along line IV-IV of FIG. 3.

FIGS. 3 and 4 illustrate a second exemplary embodiment of an electronic device 200. The electronic device 200 includes a body 21 and a sound cavity assembly 22. The body 21 and the sound cavity assembly 22 are in air communication to form a closed sound cavity 23. The electronic device 200 of the second exemplary embodiment has substantially similar structures as the electronic device 100 of the first exemplary embodiment. The device 200 includes at least a first body 211, a second body 212, a hole 213, a speaker 221, an engaging portion 224, a connecting portion 214, a first portion 2141, and a second portion 2142 which respectively correspond to the first body 111, the second body 112, the hole 113, the speaker 121, the engaging portion 124, the connecting portion 114, the first portion 1141, and the second portion 1142 of the first exemplary embodiment. A hat portion 223 of the second exemplary embodiment is different from the hat portion 123 of the first exemplary embodiment. The hat portion 223 is substantially a hollow polyhedron, which can be but is not limited to a cube, a cone, a rhombohedrum, or a trapezoid. Preferably, the hat portion 223 is a hollow trapezoid in the present embodiment. The hat portion 223 may support the electronic device 200 in a slanted standing status. The hat portion 223 includes a first bottom wall 2231, a second bottom wall 2232 parallel to the first bottom wall 2231, a first side wall 2233, and a second side wall 2234. The engaging portion 224 is perpendicularly connected to the second side wall 2234. The second side wall 2234 is parallel to the second body 212. The second side wall 2234 defines an opening 2235, the hat portion 223 is in air communication with the engaging portion 224 through the opening 2235. The cover 222 is rotated to engage the thread of the engaging portion 224 with the thread of the second portion 2142. Thus, the cover 222, the body 21, and the speaker 221 cooperatively enclose the closed sound cavity 23. The hat portion 223 resists the second body 212. When the hat portion 223 supports the electronic device 200 in a slanted state, the second bottom wall 2232 resists a placing plane, thus providing convenience for the users. Additionally, the cover 222 can enlarge a volume of the sound cavity 13. The cover 222 can be disassembled from the body 21 and exchanged for a different cover with a different size.

Figure 5:
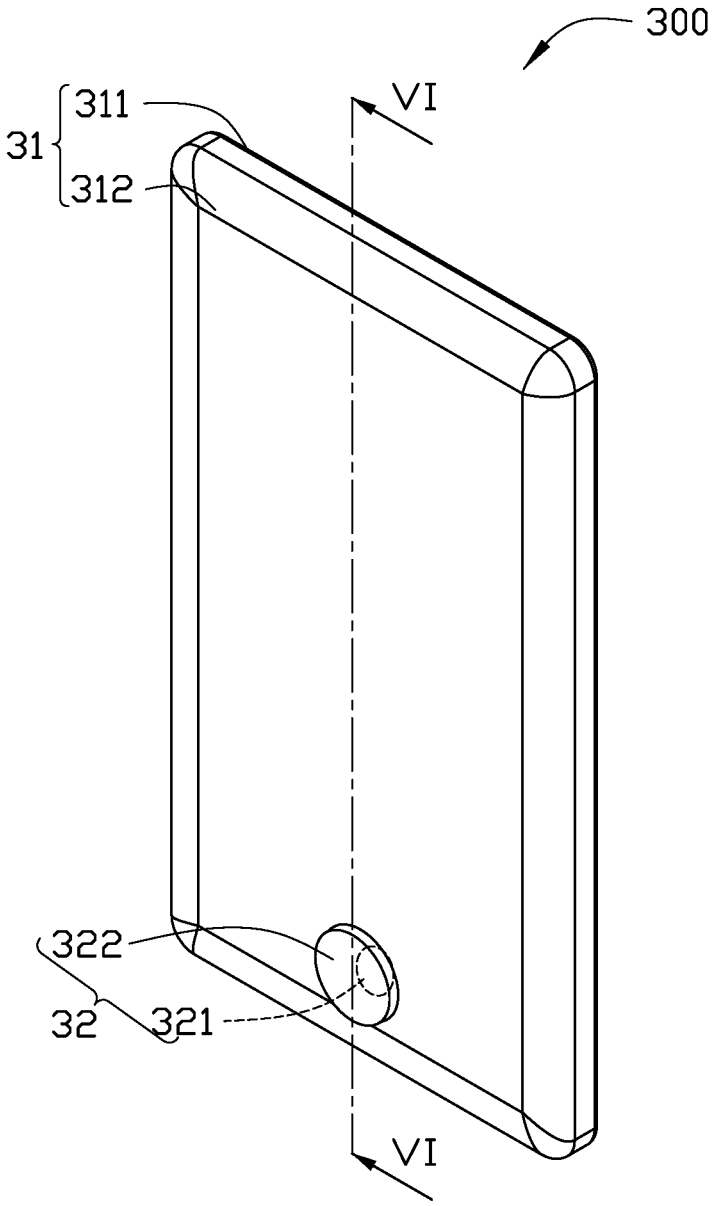
FIG. 5 is an isometric view of a third exemplary embodiment of an electronic device.
Figure 6:
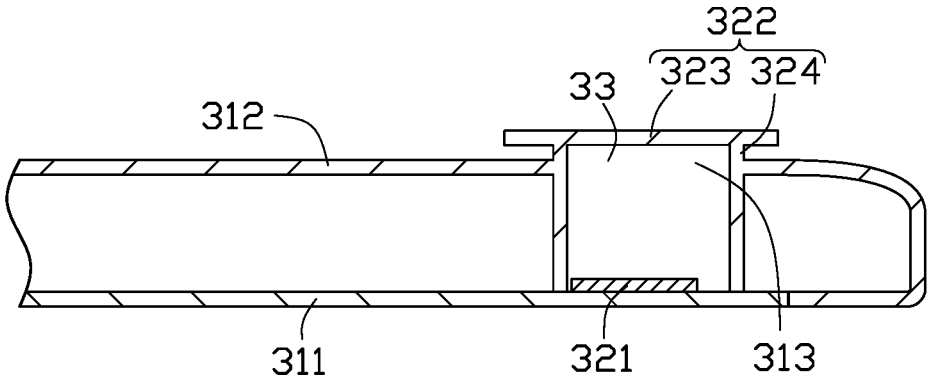
FIG. 6 is a partially cross-sectional view of the electronic device along line VI-VI of FIG. 5.

FIGS. 5 and 6 illustrate a third exemplary embodiment of an electronic device 300. The electronic device 300 includes a body 31 and a sound cavity assembly 32. The body 31 and the sound cavity assembly 32 are in air communication to form a closed sound cavity 33. The electronic device 300 of the third exemplary embodiment has substantially similar structures as the electronic device 100 of the first exemplary embodiment. The electronic device 300 includes at least a first body 311, a second body 312, a hole 313, and a speaker 321 which respectively correspond to the first body 111, the second body 112, the hole 113, and the speaker 121 of the first exemplary embodiment. A cover 322 of the third exemplary embodiment is different from the cover 122 of the first exemplary embodiment. The cover 322 includes a hat portion 323 and an engaging portion 324. The hat portion 323 is substantially perpendicular to the engaging portion 324 and correspond to the hole 313. The hat portion 323 protrudes from the second body 312. The engaging portion 324 is substantially a hollow cylinder and extends outward from the hole 313. The engaging portion 324 is coupled between the hat portion 323 and the first body 311. Thus, the cover 322, the body 31, and the speaker 321 cooperatively enclose the closed sound cavity 33. The engaging portion 324 and the body 31 can be made by injection molding technology. Therefore, the cover 322 enlarges a volume of the sound cavity 33. The cover 322 is firmly formed on the body 31 and renders the structure stronger and more stable.

Figure 7:
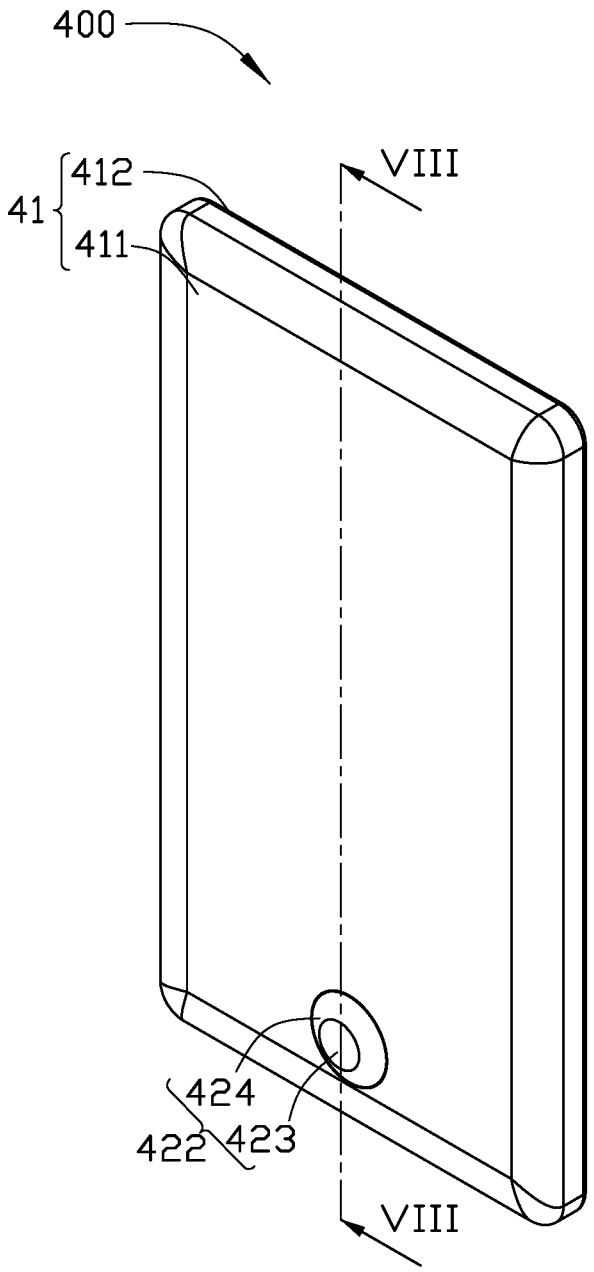
FIG. 7 is an isometric view of a fourth exemplary embodiment of an electronic device.
Figure 8:
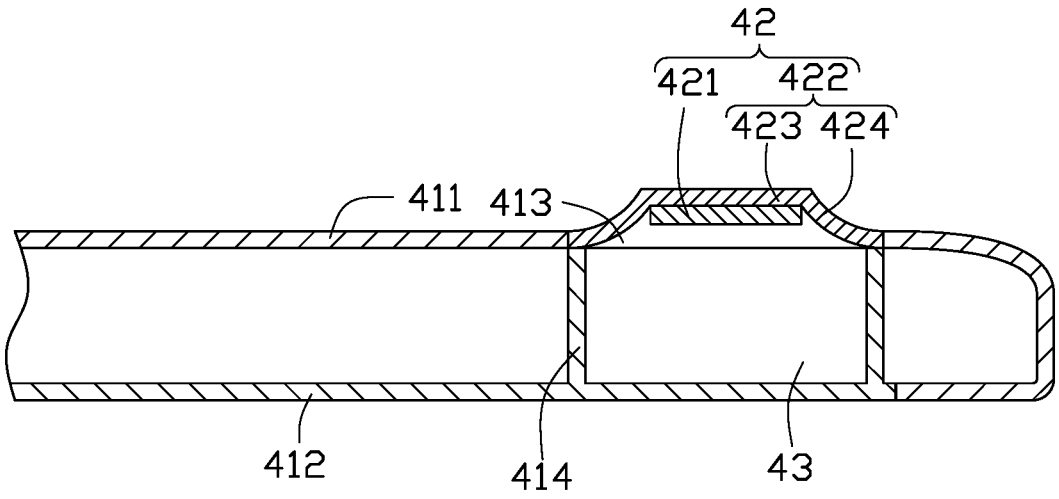
FIG. 8 is a partially cross-sectional view of the electronic device along line VIII-VIII of FIG. 7.
Figure 9:
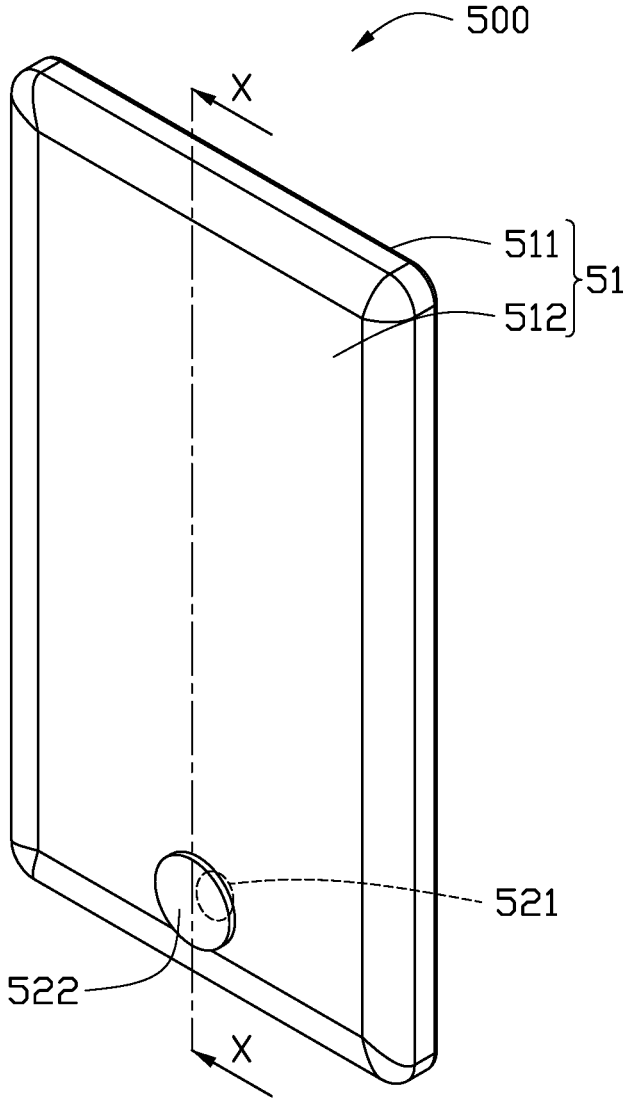
FIG. 9 is an isometric view of a fifth exemplary embodiment of an electronic device showing a sound cavity in an enlarged state.
Figure 10:
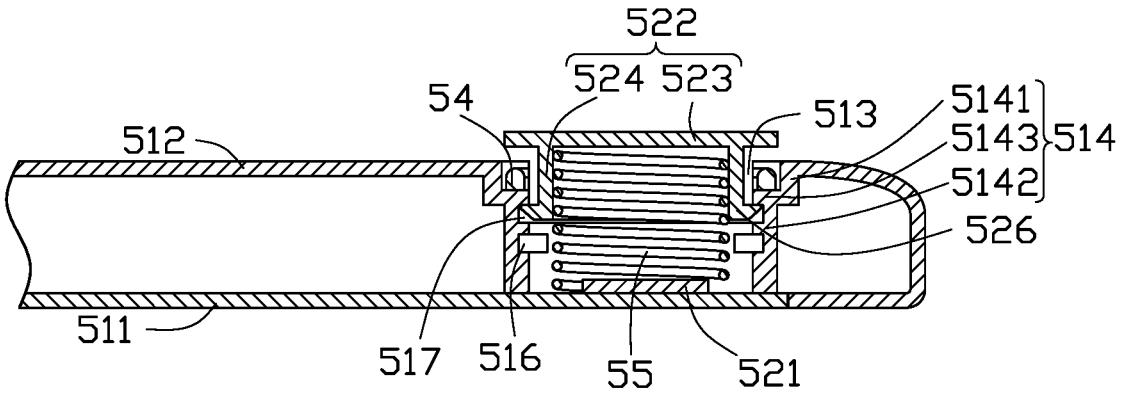
FIG. 10 is a partially cross-sectional view of the electronic device along line X-X of FIG. 9.
Figure 11:
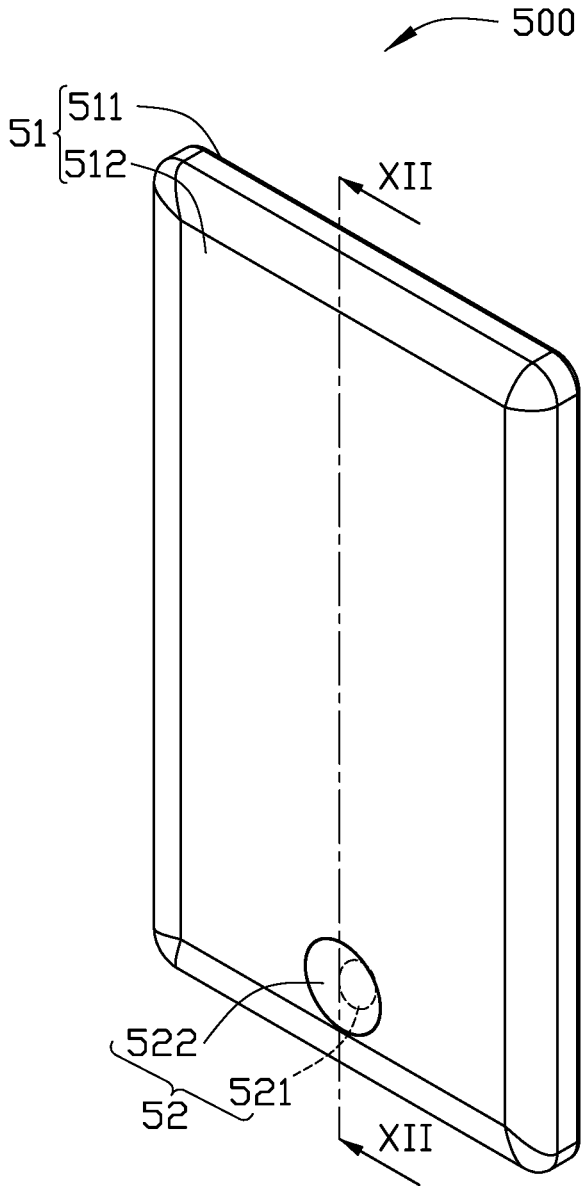
FIG. 11 is an isometric view of the fifth exemplary embodiment of the electronic device showing a sound cavity in a non-enlarged state.
Figure 12:
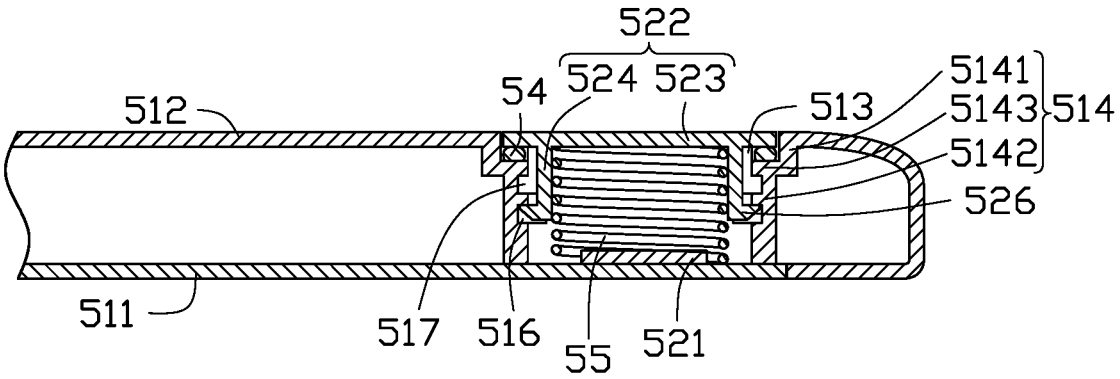
FIG. 12 is a partially cross-sectional view of the electronic device along line XII-XII of FIG. 11.

FIGS. 7 and 8 illustrate a fourth exemplary embodiment of an electronic device 400. The electronic device 400 includes a body 41 and a sound cavity assembly 42. The body 41 and the sound cavity assembly 42 are in air communication to form a closed sound cavity 43. The electronic device 400 of the fourth exemplary embodiment has substantially similar structures as the electronic device 300 of the third exemplary embodiment. The electronic device 400 includes at least a first body 411, a second body 412, a hole 413, and a speaker 421 respectively corresponding to the first body 311, the second body 312, the hole 313, and the speaker 321 of the third exemplary embodiment. A connecting portion 414 is formed by extension from the first body 411 and the hole 413 to the second body 412. The connecting portion 414 is substantially a hollow cylinder. A cover 422 of the fourth exemplary embodiment is different from the cover 322 of the third exemplary embodiment. The cover 422 includes a hat portion 423 and an engaging portion 424. The hat portion 423 protrudes from the first body 411 and corresponds to the hole 413. The engaging portion 424 is substantially an arc side wall, one end of the engaging portion 424 couples to the first body 411 and extends from the first body 411 and the hole 413 to the hat portion 423. The speaker 421 is arranged to the hat portion 423 and faces to the second body 412. Thus, the cover 422, the body 41, and the speaker 421 cooperatively enclose the closed sound cavity 43. The cover 422 and the body 41 can be made by injection molding technology. Therefore, the cover 422 enlarges a volume of the sound cavity 43.

FIGS. 9-12 illustrate a fifth exemplary embodiment of an electronic device 500. The electronic device 500 includes a body 51 and a sound cavity assembly 52. The electronic device 500 of the fifth exemplary embodiment has substantially similar structures as the electronic device 100 of the first exemplary embodiment. The electronic device 500 includes at least a first body 511, a second body 512, a hole 513, a speaker 521, a connecting portion 514 including a first portion 5141, a second portion 5142, and a step portion 5143, and a seal ring 54, respectively corresponding to the first body 111, the second body 112, the hole 113, the speaker 121, the connecting portion 114 including the first portion 1141, the second portion 1142, and the step portion 1143, and the seal ring 14 of the first exemplary embodiment. The second portion 5142 defines two symmetric grooves 516 and two symmetric slots 517. The two symmetric grooves 516 are closer to the first body 511 and the two symmetric slots 517 are closer to the second body 512.

The sound cavity assembly 52 includes the speaker 521, a cover 522, and an elastic piece 55. The cover 522 includes a hat portion 523 and an engaging portion 524. The engaging portion 524 is substantially a hollow cylinder. The hat portion 523 is substantially perpendicular to the engaging portion 524. A diameter of the hat portion 523 is greater than that of the engaging portion 524, while the diameter of the hat portion 523 is substantially same as that of the first portion 5141. The engaging portion 524 includes two symmetric latching portion 526 extended outward from an end of the engaging portion 524 away from the hat portion 523. In at least one embodiment, the two latching portions 526 are made of elastic material, such as rubber. The two latching portions 526 are selectively latched to the two grooves 516 or two slots 517. The elastic piece 55 is received in the cover 522. One end of the elastic piece 55 resists the hat portion 523 and the other end of the elastic piece 55 resists the first body 511. Thus, the cover 522, the body 51, and the speaker 521 cooperatively enclose a closed sound cavity 53. In at least one embodiment, the elastic piece 55 can be but is not limited to a spring.

When an enlarged sound cavity 53 is not needed, the latching portions 526 latch to the grooves 516, the hat portion 523 is flush with the second body 512, and the elastic piece 55 is compressed by the hat portion 523. When an enlarged sound cavity 53 is needed, the hat portion 523 can be pressed by the user to move towards the second portion 5142, thus the latching portions 526 leaves the grooves 516. The hat portion 523 can be rotated to render the hat portion 523 not flush with the grooves 516. The hat portion 523 is released. The elastic piece 55 elastically restores and pushes the cover 522 moves away from the second body 512 until the latching portions 526 latch to the slots 517. In this state, the hat portion 523 protrudes from the second body 512. Therefore, the volume of the sound cavity 53 of the electronic device 500 is enlarged. The cover 522 can be pressed and rotated to enlarge or decrease the volume of the sound cavity 53 of the electronic device 500, the cover 522 being movable, and the operation to the cover 522 is convenient for user.

The electronic devices 100, 200, 300, 400, and 500 respectively include cover 122, 222, 322, 422, and 522 to enlarge the volume of the sound cavities 13, 23, 33, 43, and 53 to improve the bass effect for the electronic device 100, 200, 300, 400, and 500. Additionally, the cover 122, 222, 322, 422, and 522 do not change the internal space of the electronic devices 100, 200, 300, 400, and 500, which enables miniaturization of the electronic devices 100, 200, 300, 400, and 500.

In another exemplary embodiment, the connecting portions 114, 214, and 514 of the respective electronic devices 100, 200, and 500 can be a hollow cylinder instead of structures of the first portions 1141, 2141, and 5141 and the second portions 1142, 2142, and 5142, respectively. The engaging portions 124, 224, and 524 and the respectively connecting portions 114, 214, and 514 can be engaged with other engaging structures.

It is believed that the exemplary embodiments and their advantages will be understood from the foregoing description, and it will be apparent that various changes may be made thereto without departing from the scope of the disclosure or sacrificing all of its advantages. The examples herein described are mere illustrative exemplary embodiments of the disclosure.

What is claimed is:

1. An electronic device comprising:

a body comprising a first body and a second body, the second body defining a hole; and a sound cavity assembly coupled to the body and forming a sound cavity cooperatively with the body, the sound cavity assembly comprising:

a speaker; a cover coupled to the body and at least partially protruding from the body to adjust a volume of the sound cavity, the cover comprising a hat portion protruding from the second body; and an elastic piece received in the cover, one end of the elastic piece resisting against the hat portion and the other end of the elastic piece resisting against the first body;

wherein the speaker is received in the body; the cover comprises an engaging portion extending from the hat portion, the engaging portion is movably coupled to the second body;

wherein the second body further comprises a connecting portion, the connecting portion extends from a portion of the second body defining the hole towards the first body, the connecting portion is a hollow cylinder, an internal wall of the connecting portion comprises a first thread, an external wall of the engaging portion comprises a second thread corresponding to the first thread; the engaging portion engages with the connecting portion through the first thread and the second thread;

wherein the connecting portion comprises a first portion and a second portion, the first portion extends from a portion of the second body defining the hole, the second portion extends from the first portion towards the first body, a diameter of the second portion is smaller than that of the first portion, and a step portion is formed connecting the first portion and the second portion.

2. The electronic device as claimed in claim 1, wherein a diameter of the hat portion is greater than that of the engaging portion, the diameter of the hat portion is substantially same as that of the first portion, and the diameter of the engaging portion is substantially same as that of the second portion.

3. The electronic device as claimed in claim 1, wherein the second portion defines two symmetric grooves and two symmetric slots; the two symmetric grooves are closer to the first body and the two symmetric slots are closer to the second body; the engaging portion includes two symmetric latching portion extended outwardly from an end of the engaging portion away from the hat portion; the two latching portions are selectively latched to the two grooves or the two slots.

4. The electronic device as claimed in claim 3, wherein the two latching portions are made of elastic material.

5. The electronic device as claimed in claim 1, wherein the sound cavity assembly further comprises a seal ring, the seal ring is arranged to an internal wall of the first portion and on the step portion; an external diameter of the seal ring is substantially same as an inner diameter of the first portion, an inner diameter of the seal ring is substantially same as an inner diameter of the second portion, and a thickness of the seal ring is smaller than a height of the first portion.

6. An electronic device comprising:

a body comprising a first body and a second body, the second body defining a hole; and a sound cavity assembly coupled to the body and forming a sound cavity cooperatively with the body, the sound cavity assembly comprising:

a speaker; a cover coupled to the body and at least partially protruding from the body to adjust a volume of the sound cavity, the cover comprising a hat portion protruding from the second body; and an elastic piece received in the cover, one end of the elastic piece resisting against the hat portion and the other end of the elastic piece resisting against the first body;

wherein the speaker is received in the body; the cover comprises an engaging portion extending from the hat portion, the engaging portion movably coupled to the second body;

wherein the second body further comprises a connecting portion, the connecting portion extends from a portion of the second body defining the hole towards the first body, the connecting portion is a hollow cylinder, an internal wall of the connecting portion comprises a first thread, an external wall of the engaging portion comprises a second thread corresponding to the first thread; the engaging portion engages with the connecting portion through the first thread and the second thread;

wherein the hat portion is a hollow polyhedron, the hat portion supports the electronic device to be in a standing status;

wherein the hat portion includes a first bottom wall, a second bottom wall, a first side wall, and a second side wall, the engaging portion is perpendicularly connected to the second side wall, the second side wall defines an opening, the hat portion is in air communication with the engaging portion through the opening;

wherein the elastic piece is a spring.

7. An electronic device comprising:

a body comprising a first body and a second body, the second body defining a hole; and a sound cavity assembly coupled to the body and forming a sound cavity cooperatively with the body, the sound cavity assembly comprising:

a speaker; a cover coupled to the body and at least partially protruding from the body to adjust a volume of the sound cavity, the cover comprising a hat portion protruding from the second body; and an elastic piece received in the cover, one end of the elastic piece resisting against the hat portion and the other end of the elastic piece resisting against the first body;

wherein the speaker is received in the body; the cover comprises an engaging portion extending from the hat portion, the engaging portion movably coupled to the second body;

wherein the second body further comprises a connecting portion, the connecting portion extends from a portion of the second body defining the hole towards the first body, the connecting portion is a hollow cylinder, an internal wall of the connecting portion comprises a first thread, an external wall of the engaging portion comprises a second thread corresponding to the first thread; the engaging portion engages with the connecting portion through the first thread and the second thread;

wherein the hat portion is a hollow polyhedron, the hat portion supports the electronic device to be in a standing status;

wherein the hat portion includes a first bottom wall, a second bottom wall, a first side wall, and a second side wall, the engaging portion is perpendicularly connected to the second side wall, the second side wall defines an opening, the hat portion is in air communication with the engaging portion through the opening;

when the latching portions latch to the grooves, the hat portion is flush with the second body, the elastic piece is compressed by the hat portion, thus the sound cavity is in a non-enlarged status.

8. The electronic device as claimed in claim 7, wherein when hat portion is pressed by an external force and moves towards the second portion, the latching portions leave the grooves so that the hat portion is not flush with the grooves, the hat portion is released, the elastic piece elastically restores and pushes the cover to move away from the second body until the latching portions latch to the slots, thus the sound cavity is in an enlarged status.

9. The electronic device as claimed in claim 8, wherein when the sound cavity is in the enlarged status, the hat portion protrudes from the second body.

* * * * *